United States Patent [19]

Stancato

[11] Patent Number: 4,601,489

[45] Date of Patent: Jul. 22, 1986

[54] ALBUM DESIGN AND METHOD OF FABRICATION

[76] Inventor: Enzo Stancato, 33 Windy Knolls, Greenwich, Conn. 06830

[21] Appl. No.: 759,482

[22] Filed: Jul. 26, 1985

[51] Int. Cl.[4] ..... B42D 1/08

[52] U.S. Cl. ..... 281/21 R; 40/533; 40/530; 40/159; 16/257; 281/17; 281/19 R; 281/22; 281/38; 402/79; 402/501

[58] Field of Search ..... 16/13, 29, 257; 40/159, 40/388, 390, 394, 401, 530, 533; 281/15 R, 19 R, 17, 21 R, 22, 26, 25 R, 31, 38, 42, 45, 46, 50; 402/79, 80 R, 70, 500, 501, 502, 503

[56] References Cited

U.S. PATENT DOCUMENTS

| | | | |
|---|---|---|---|
| 39,300 | 7/1863 | Mets | 281/15 R |
| 394,189 | 12/1888 | Kinnard | 281/45 |
| 1,530,230 | 3/1925 | Brown | 402/70 |
| 2,127,619 | 8/1938 | Rosenthal | 281/17 |
| 2,250,018 | 7/1941 | Gundell | 281/38 X |
| 2,811,768 | 11/1957 | Axelson | 16/257 X |
| 2,850,294 | 9/1958 | Ortis et al. | 281/31 |
| 3,243,838 | 4/1966 | Blumberg | 16/257 |
| 3,328,831 | 7/1967 | Fiore, Jr. | 16/257 |
| 3,353,844 | 11/1967 | Staats | 281/17 |
| 3,752,503 | 8/1973 | Holes et al. | 281/17 |
| 4,140,565 | 2/1979 | Parker et al. | 281/22 X |
| 4,378,647 | 4/1983 | Stancato | 40/158 R |
| 4,521,035 | 6/1985 | Berezowsky | 40/530 X |

FOREIGN PATENT DOCUMENTS

| | | | |
|---|---|---|---|
| 1376534 | 9/1964 | France | 40/533 |
| 1390549 | 1/1965 | France | 16/257 |
| 165974 | 1/1981 | Netherlands | 402/79 |
| 547524 | 9/1942 | United Kingdom | 402/79 |

*Primary Examiner*—Paul A. Bell

[57] ABSTRACT

This invention relates to an improved design associated with an album whose appearance evidences that of prebound construction and the method for the fabricating thereof such that there is able to be created an album of as many pages as desired, each page capable of being interlocked by means of an interconnecting spinal component affixed as part of each and every page such that upon the interconnecting of said spinal members of each and every page, there is achieved the appearance of a prebound album along with having the structural integrity of same but which has in fact the capability of being selectively assembled to any desired number of pages. Additionally, each page is constructed so as to permit the insertion on to each surface thereof an item to be displayed, be it a picture, or otherwise, such that there is achieved as an overall appearance as to each and every page an aesthetically appealing display along with a consistently uniform flat surface. Consistent with the invention is the capability of having an album additionally comprise a front and a back cover with a tongue portion affixed to one of said covers and capable of insertion within the inside surface of the other of said covers such that said tongue portion is capable of covering the exposed binding of the album being fabricated independent of the number of pages to be utilized and being such as to provide an aesthetically appealing appearance equivalent to that of a prebound album.

5 Claims, 17 Drawing Figures

ALBUM DESIGN AND METHOD OF FABRICATION

BACKGROUND AND OBJECTS OF THE INVENTION

The present invention relates generally to a new and improved design for an album and method for fabrication of same, the appearance of said album evidencing that of a prebound construction and the method for the fabrication thereof being such so as to be able to create an album of as many pages as desired, each page being capable of being interlocked with other pages by means of interconnecting spinal components affixed as part of each and every page utilized in said album. Upon the interconnecting of said spinal members of each and every page, there is achieved the appearance of a prebound album along with having the structural integrity of same but which has in fact the capability of being selectively assembled to any desired number of pages. Additionally, each page is constructed so as to permit the insertion on to each surface thereof an item to be displayed, be it a picture, or otherwise, such that there is achieved an overall aesthetically appealing display as to each and every page along with achieving a consistently uniform flat surface for each of said pages.

Furthermore, in keeping with the invention, there is provided a front and back cover that are capable of interconnecting through their own spinal components to the pages as assembled in accordance with the invention so as to provide an aesthetically appealing front and back cover to said album as well as having a tongue portion affixed to one of said covers and capable of insertion within the inside surface of the other of said covers such that said tongue portion covers the exposed binding portions of the assembled pages of said album so as to provide an aesthetically appealing appearance equivalent to that of a prebound album.

Prior to the present invention, albums existed but of a design and fabrication which did not achieve the advantages of the present invention and were not capable of providing the overall advantages and achievements consistent with the present design.

It is therefore an object of this invention to create a new and unique album design and method of fabrication of same wherein an album is created by the interconnection of individual page members which gives the aesthetic appearance of a prebound album as well as providing the structural integrity of same.

It is another object of this invention to create a new and unique album design and method of fabrication of same wherein each individual page is capable of receiving thereon a decorative item aesthetically mounted but yet capable of replacement if desired.

The objects and advantages of the invention are set forth in part herein and in part will be obvious herefrom, or may be learned by practice of the invention, the same being realized and attained by means of the instrumentalities and combinations pointed out in the appended claims.

The invention consists in the novel parts, constructions, arrangements, combinations and improvements herein shown and described.

SUMMARY OF THE INVENTION

This invention relates to an improved design associated with an album whose appearance evidences that of prebound construction and the method for the fabricating thereof such that there is able to be created an album of as many pages as desired, each page capable of being interlocked by means of an interconnecting spinal component affixed as part of each and every page such that upon the interconnecting of said spinal members of each and every page, there is achieved the appearance of a prebound album along with having the structural integrity of same but which has in fact the capability of being selectively assembled to any desired number of pages. Additionally, each page is constructed so as to permit the insertion on to each surface thereof an item to be displayed, be it a picture, or otherwise, such that there is achieved as an overall appearance as to each and every page an aesthetically appealing display along with a consistently uniform flat surface. Consistent with the invention is the capability of having the album additionally comprise a front and back cover with a tongue portion affixed to one of said covers and capable of insertion within the inside surface of the other of said covers such that said tongue portion is capable of covering the exposed binding of the album being fabricated independent of the number of pages to be utilized and being such as to provide an aesthetically appealing appearance equivalent to that of a prebound album.

The accompanying drawings referred to herein and constituting a part hereof are illustrative of the invention but not restrictive thereof, and, together with the description, serve to explain the principles of the invention.

DESCRIPTION OF A PREFERRED EMBODIMENT

Figure 1:
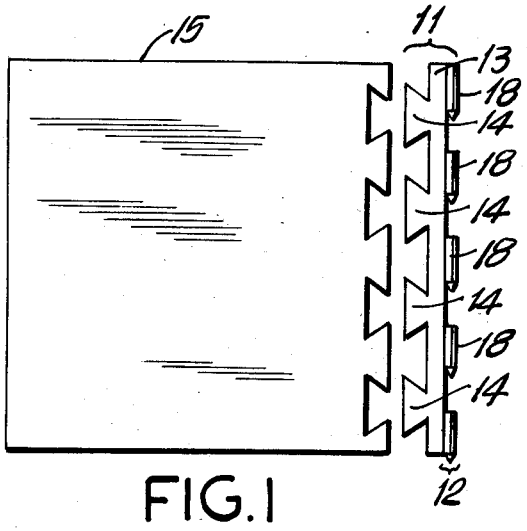
FIG. 1 is a front elevational view of the center core of a page of the album constructed in accordance with the invention evidencing the interconnecting spinal component utilized in said invention.

Referring now more particularly to the embodiment of the above invention illustrated in the accompanying drawings, there is illustrated in FIG. 1 a front elevational view of the center core 15 of a page 10 of an album constructed in accordance with the invention wherein there is further depicted the interconnecting spinal component 11 utilized in conjunction therewith. More particularly, interconnecting spinal component 11 comprises an interconnecting tubular array 12 having individual spine members 18 angularly affixed to structural member 13 whose exposed portion is fashioned to form tab members 14 along the entire length of structural member 13, tab members 14 depicted in the preferred embodiment as illustrated in FIG. 1 are of a trapezoidal configuration although the scope of this invention should not be considered to be so limiting.

Center core 15 of page 10 is basically rectangular in shape, however, it has formed along its edge that is to be compatible with interconnecting spinal component 11 an array of symmetrically positioned trapezoidal openings compatible with interfitting with tab members 14 of interconnecting spinal component 11. By having tab members 14 of interconnecting spinal component 11 interfit with the trapezoidal openings in center core 15 of page 10, there is achieved a structurally integrated interfit between center core 15 and interconnecting spinal component 11 that provides structural integrity to page 10 consistent with the present invention. Obviously if tab members 14 are fashioned into a shape other than trapezoidal as illustrated in FIG. 1, same being within the scope of this invention, then the openings formed in center core 15 that are to interfit with said tab members 14 shall be of a compatible shape so as to achieve said interfit.

Figure 2:
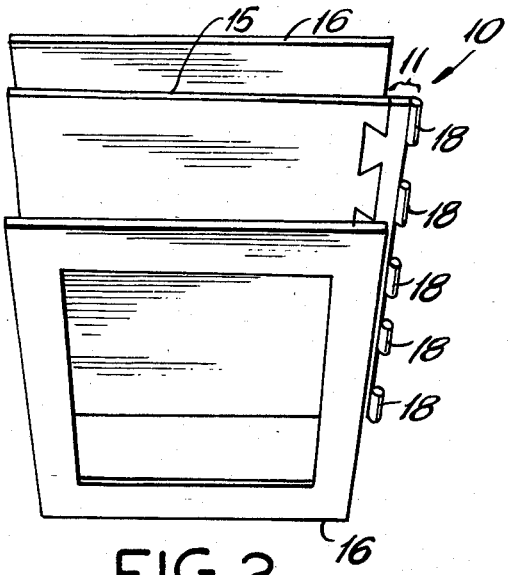
FIG. 2 is a three dimensional exploded perspective view of a page of the album constructed in accordance with the invention evidencing the center core of a page with its respective guide members appearing upon either side of the center core prior to adhesively affixing said guide members to said center core of said page.

In further keeping with the invention, and as depicted in FIG. 2, upon having interconnecting spinal component 11 interfit with center core 15 of page 10, there is then adhesively positioned on to both faces of center core 15 guide members 16 whose outer dimensions are identical to those of center core 15 thus inclusive of that portion of interconnecting spinal component 11 that interlocks with center core 15. Because of the fact that guide member 16 has a rectangular opening symmetrically cut through its center, a page 10 is created capable of receiving a mat 17 as will be more fully set forth hereinafter. Additionally, the adhesive positioning of quide members 16 upon the front and back faces of center core 15 covers the interlock area between interconnecting spinal component 11 and center core 15 and thus acts as an adhesive bond across said boundary thereby providing a mechanically sound structural interconnection between the components of page 10, to wit, interconnecting spinal component 11 and center core 15. Furthermore, since the thickness of center core 15 and the thickness of interconnecting spinal component 11 are identical, there is achieved in accordance with the above a uniformed thickness for page 10 along with providing an indent area on both the front and back faces of page 10, same being defined by the cut out area defined by guide members 16.

Additionally, it should be noted, that although the opening formed in guide members 16 as depicted in FIG. 2 is referred to as rectangular, nothing herein should be considered to be so limiting of the invention, it being within the scope of the invention for said opening to take the form of any geometrical shape.

Figure 8:
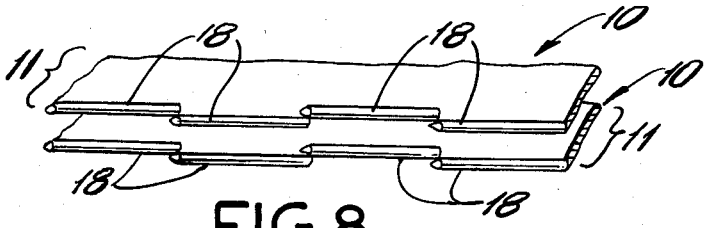
FIG. 8 is a partial perspective view of two pages of an album constructed in accordance with the invention prior to the mechanical interfit of their respective spinal components.

In conjunction with interconnecting spinal component 11, reference is now herein made to FIG. 8 wherein there is depicted a partial perspective view of two pages of an album constructed in accordance with the invention prior to having there occur the mechanical interfit of their respective spinal components 11.

More particularly, as illustrated in FIG. 8, two partial portions of two pages 10 are depicted side by side in horizontal positioning adjacent to each other evidencing how the interconnecting spinal component 11 of each are able to create a mechanical interfit as between themselves by the mechanical interfit of the individual spine members 18 so as to provide the basis for the fashioning of an album giving the appearance of being prebound and providing the structural integrity at the interfitting of said interconnecting spinal components 11 that is equivalent to a prebound album as well as providing the capability of rotational movement related thereto inherent in any prebound album design.

In keeping with the invention, and as set forth in FIG. 8, each interconnecting spinal component 11 as depicted therein has individual spine members 18 that are alternately offset from each other by an amount equivalent to the diameter of each of said spine members 18 along the edge of interconnecting spinal component 11 as depicted in FIG. 8. As set forth in this preferred embodiment, each individual spine member 18 is cylindrical in shape being formed at its lower end into a pointed configuration and being formed at its upper end into a cupped configuration, the cupped configuration being such as to be able to mechanically receive in an interfit relationship the point configuration from another spine member 18 but yet permit rotational movement about the common axis of said interfitted spine members 18.

Figure 9:
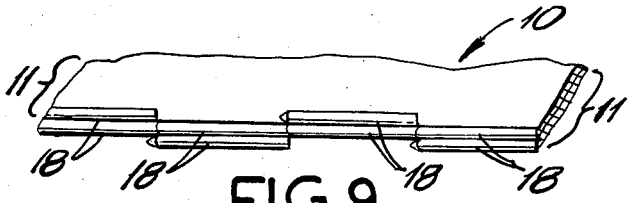
FIG. 9 is a partial front elevational view evidencing two pages of an album constructed in accordance with the invention having each of their respective spinal components connected to each and thus mechanically interfaced with each other in accordance with the invention.

In keeping with the invention, and as depicted in FIG. 9, the adjacent pages 10 as set forth in FIG. 8 are positioned directly side by side with each other such that the individual spine members 18 of the respective pages 10 have been mechanically positioned such that the respective spine members 18 of each of said respective pages 10 have been snapped into place in mechanical interfit with each other as depicted in FIG. 9, said mechanical interfit being such as to provide structural integrity between each of the two pages 10 equivalent to that of mechanical binding as well as providing the capability of rotational movement about the common axis of an alignment of a particular array of said spine members 18 interfitted as therein illustrated so as to permit rotational movement of one of said pages 10 away from the other of said pages 10 as is necessary to achieve a functional album design.

In this manner, and in accordance with the invention, there is achieved the ability to interconnect as many pages as desired merely by causing the respective spine members 18 of the respective pages 10 to snap into interfit with each other as illustrated in FIG. 9 with the result that there is achieved the creation of an album capable of evidencing a prebound appearance when in fact same is not the case, as well as providing the additional features of creating an album whose mechanical integrity due to the mechanical interfit of the respective spine members 18 is such as to achieve a binding arrangement equivalent to that of a prebound album but with the design feature of being able to, in effect, assemble an album with any desired number of pages, as particular case may require.

Figure 11:
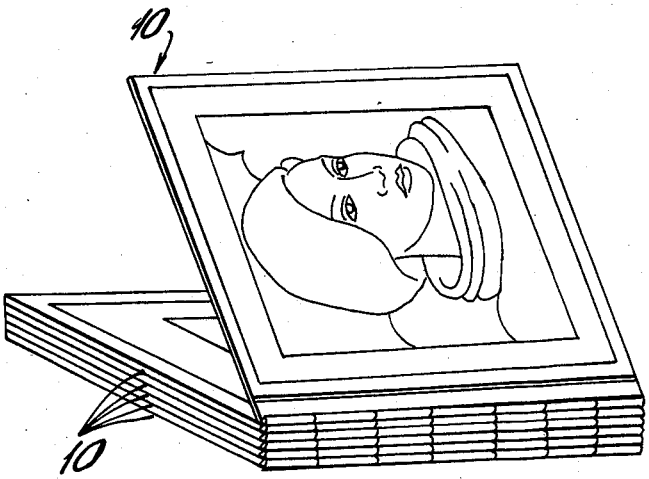
FIG. 11 is a perspective view of a number of pages of an album constructed in accordance with the invention having their respective spinal components mechanically interfitted with each other so as to provide a mechanically interrelated binding in accordance with the invention.
Figure 12:
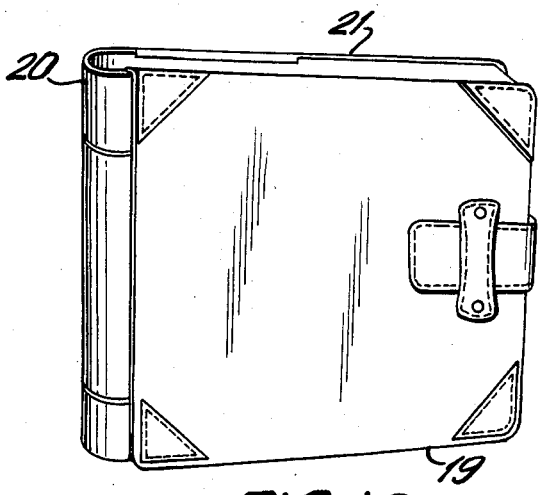
FIG. 12 is a perspective view of an album constructed in accordance with the invention evidencing an artistically decorative outer cover.

In FIG. 11, there is depicted a series of pages 10 interconnected through the interconnecting spine members 18 as illustrated in FIGS. 8 and 9, same being in accordance with the invention and evidencing the potential of the invention in achieving the appearance of a prebound album but with the flexibility of being able to determine the number of pages upon assembly thereof as a particular need may dictate. As illustrated in FIG. 11, there is illustrated an album design within the scope of this invention that does not require a separate front cover 19 or a separate back cover 21, but merely relies upon the individual page members 10 to comprise a completely functional album design. As illustrated in FIG. 11, the top page 10 of the interconnected pages 10 therein illustrated forms, in effect, the front cover of said album and the bottom page 10 thereof, in effect, forms the back cover. A decorative insert such as a picture 24 can be utilized as desired for the front cover of such an album as well as for the back cover thereof, same being within the discretion of the party fabricating same. Additionally, under such design criteria, the interconnecting spinal component 11 of the top page 10 and the bottom page 10 of such an album is modified as illustrated in FIG. 11 so as to omit the spine members 18 that would normally be formed as illustrated in FIG. 8 and FIG. 9 for utilization in interconnecting with additional pages 10. By so doing, and in accordance with the invention, there is achieved a functional and an aesthetically appealing album design as illustrated in FIG. 11.

Figure 4:
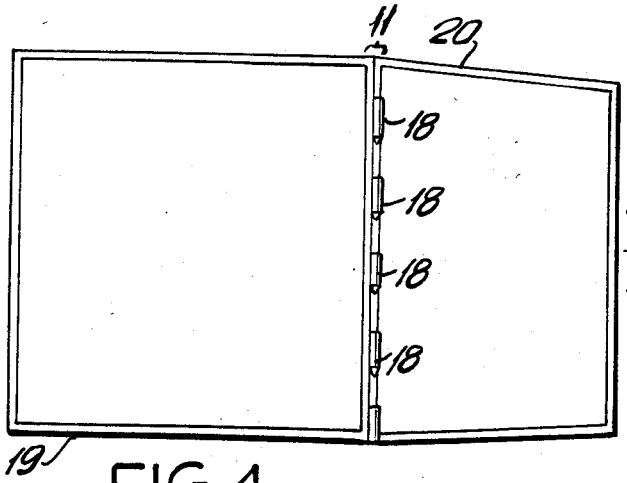
FIG. 4 is a front elevational view evidencing the interior portion of the front cover of said album prior to its assembly in the construction of an album.
Figure 5:
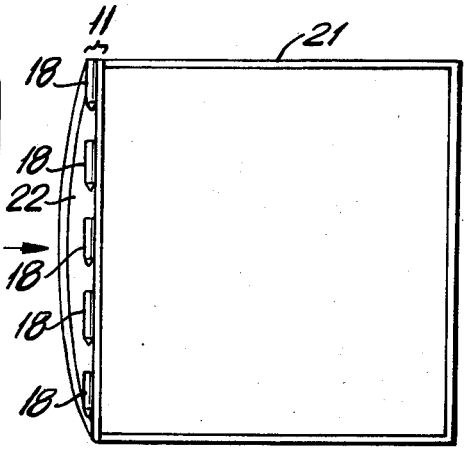
FIG. 5 is a front elevational view evidencing the interior portion of the back cover of said album prior to its assembly in the construction of an album.

In further keeping with the invention and referring to FIGS. 4 and 5 of the drawings, there is depicted in FIG. 4 a front elevational view of the interior portion of a front cover 19 of an album fabricated in accordance with the invention, wherein the interconnecting spinal component 11 utilized in conjunction therewith is mechanically affixed to the interior portion thereof as therein depicted and tongue member 20 is physically affixed thereto.

In fabricating the album in accordance with the invention, interconnecting spinal component 11 of front cover 19 has its spine members 18 interconnecting as depicted in FIGS. 8 and 9 of the drawings with the spinal members 18 of the top page of the album being fashioned, thereby creating a mechanical interfit there between through the interconnection of spine members 18.

Figure 3:
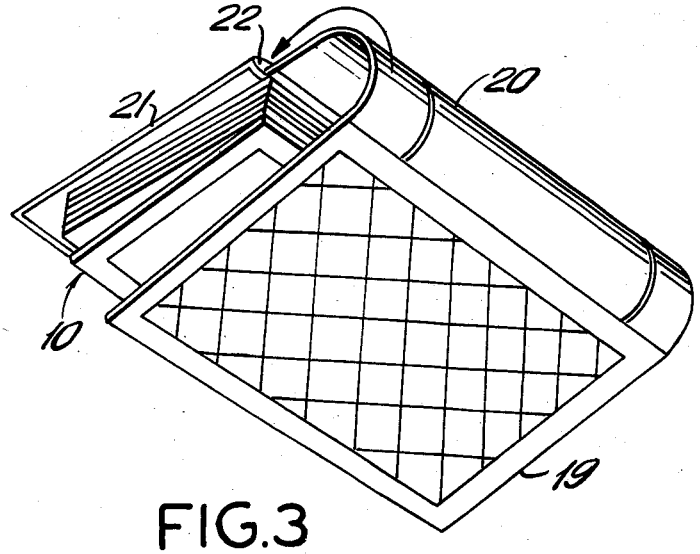
FIG. 3 is a three dimensional perspective view of an album constructed in accordance with the invention evidencing the method by which an external cover is fashioned so as to be utilized to provide a prebound appearance to said fashioned album independent of the number of pages to be utilized in constructing said album.
Figure 6:
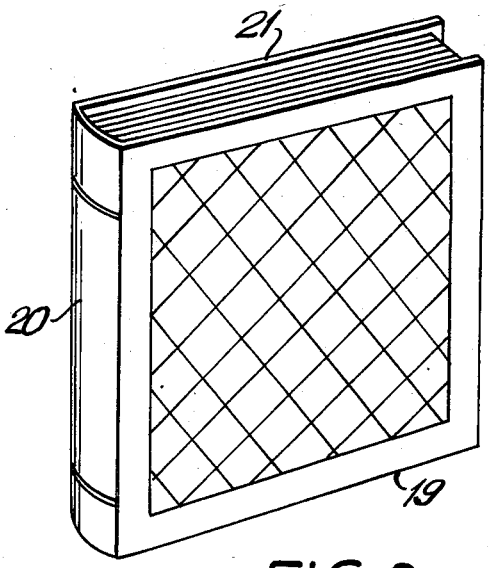
FIG. 6 is a three dimensional perspective view of a completed album constructed in accordance with the invention.

Additionally, as depicted in FIG. 5, which is a front elevational view evidencing the interior portion of back cover 21 of an album fabricated in accordance with the invention, back cover 21 also has mechanically affixed to its interior its own interconnecting spinal component 11 which mechanically interconnects with spine members 18 of the last page of a proposed album in a fashion depicted in FIGS. 8 and 9 of the drawings. Additionally, back cover 21 has fashioned a pouch 22 into which is inserted tongue member 20 as depicted in FIG. 3 of the drawings such that there is achieved as depicted in FIG. 6 of the drawings an album constructed in accordance with the invention whose appearance is identical to that of a prebound album but whose construction is such as to be fabricated in a manner that permits the varying of the number of individual pages 10 that shall be contained therein.

Figure 10:
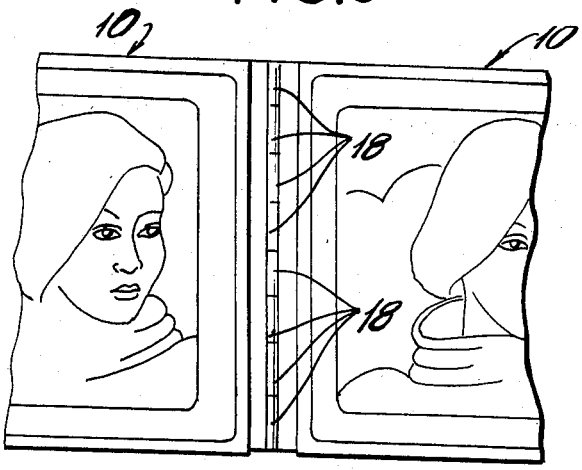
FIG. 10 is a partial front elevational view of two pages of an album constructed in accordance with the invention opened to evidence a flat plane.

In conjunction with the above, and as set forth in FIG. 10, the album constructed in accordance with the invention is capable of having the respective pages open about the center axis of spine members 18 so as to provide a contiguous plane surface across both pages of the opened album thereby providing an aesthetically appealing album design.

Figure 7:
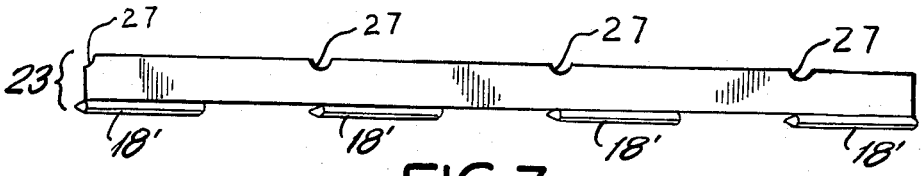
FIG. 7 is a front elevational view of an alternative embodiment of the spinal component to be utilized in accordance with the invention.

Additionally, and in keeping with the invention, there is set forth in FIG. 7 an alternative embodiment of interconnecting spinal component 11, said interconnecting spinal component 23 as therein set forth evidencing spine members 18' fashioned in accordance with the design and construction evidenced in FIGS. 8 and 9 of the drawings, however, interconnecting spinal component 23 not being fashioned as to provide symmetrical trapezoidal configurations 14 associated with structural member 13, as illustrated in FIG. 1 and FIG. 2, but rather, merely having the structure of interconnecting spinal component 23 which is equivalent to that of structural member 13 be merely rectangular in shape as depicted in FIG. 7 and thus not form inherent to its own design a mechanical interfit with center core 15 of page 10 upon assembly therewith as depicted in FIG. 2, but rather, upon utilizing the alternative embodiment of interconnecting spinal component 23 in fashioning a page 10, said structural integrity between interconnecting spinal component 23 and center core 15 relies solely upon the structural strength of guide members 16 and its adhesive qualities. Furthermore, as illustrated in FIG. 7, the indents 27 formed in interconnecting spinal component 23 provide for a depository of adhesive common to interconnecting spinal component 23, center core 15, and guide members 16 so as to provide for added structural integrity therebetween when interconnecting spinal component 23 is utilized.

Figure 13:
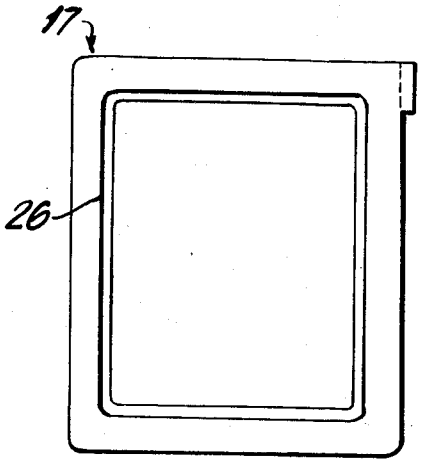
FIG. 13 is a front elevational view of a mat constructed in accordance with the invention.
Figure 14:
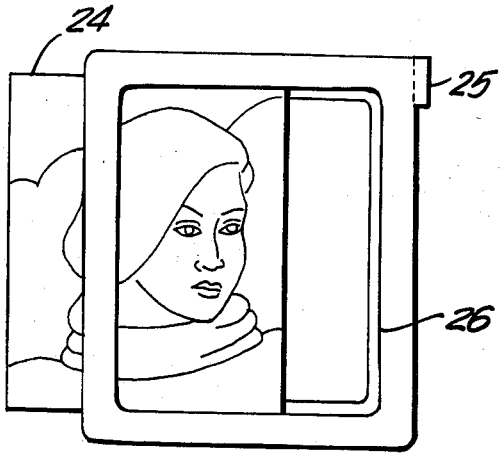
FIG. 14 is a front elevational view of the mat depicted in FIG. 13 with a partially inserted photograph.

Referring now to FIG. 13 there is therein set forth mat 17 evidencing a recessed opening 26 capable of receiving the insert of a photograph 24 as further depicted in FIG. 14. Mat 17 is constructed in accordance with techniques well-known within the prior art wherein as depicted in FIG. 14, an envelope arrangement is created capable of receiving the insert of a photograph 24 which, when once inserted within mat 17, there is created an aesthetically appealing arrangement as depicted in FIG. 15 whereby a photograph is given the appearance of being professionally mounted within an aesthetically appealing framed setting.

Figure 15:
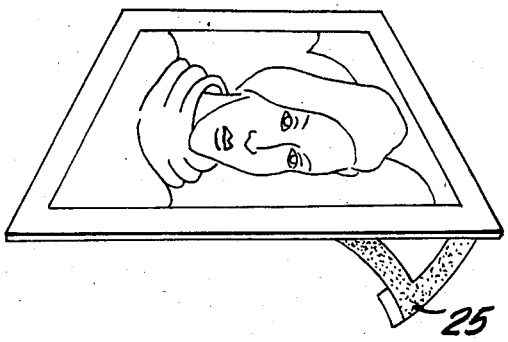
FIG. 15 is a perspective view of the mat of FIG. 14 having a picture inserted therein wherein there is further depicted the removal of the protective covering over an adhesive surface.

In keeping with the invention, and as depicted in FIG. 15, protective covering 25 is affixed to the back portion of mat 17 such that it covers an adhesive surface affixed to the back of mat 17 such that upon removal of protective covering 25 from the back of mat 17 there is exposed the adhesive surface which in effect borders the perimeter of the back of mat 17.

Figure 16:
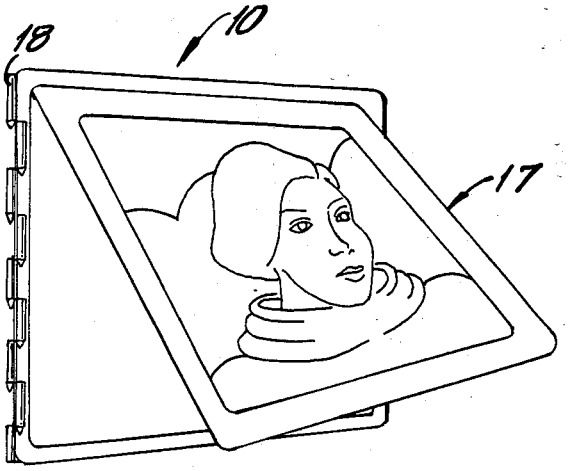
FIG. 16 is a perspective view of the mat of FIG. 15 being placed upon a page of an album so as to permit the exposed adhesive surface appearing on the back of said mat to adhere to the page of said album.

As set forth in FIG. 16, mat 17 with picture 24 inserted therein after having protective covering 25 removed and thus exposing the adhesive surface appearing on the back of mat 17 is then inserted within the recess defined with regard to the construction of page 10, the dimensions of mat 17 and the dimensions of the recess appearing on the face of page 10 as depicted in FIG. 16 being compatible such that mat 17 fits exactly within the recess defined on the front face of page 10, the thickness of mat 17 and the thickness of guide member 16 being identical such that once mat 17 is inserted onto page 10 as illustrated in FIG. 16, there is achieved a uniform plane surface appearance to page 10. As depicted in FIG. 16, mat 17 is adhesively affixed to page 10 as a result of having had exposed the adhesive portion of the back surface of mat 17 as illustrated in FIG. 15 by having protective covering 25 removed prior to inserting mat 17 into the recess of page 10.

Figure 17:
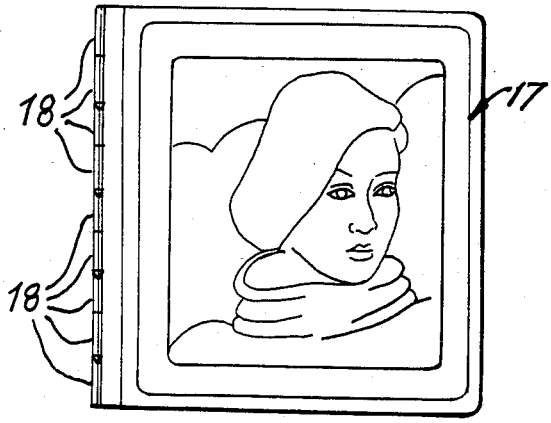
FIG. 17 is a front elevational view of the page of FIG. 16 interfitted with other pages of the album in accordance with the invention.

As illustrated in FIG. 17, a completely assembled page 10 is depicted with mat 17 having been inserted thereupon in accordance with the steps set forth above, picture 24 having been inserted into mat 17 prior to its being mounted upon page 10. As depicted in FIG. 17, page 10 has been mechanically interlocked through the respective spinal members 18 as therein depicted with another page 10 positioned immediately beneath the page 10 as illustrated in FIG. 17.

In keeping with the invention, it should further be noted that once mat 17 has been mounted upon page 10 having had positioned therein picture 24, it is within the scope of the invention to enable the removal of picture 24 from the envelope arrangement of mat 17 after mat 17 has been mounted upon page 10 and have picture 24 replaced with another picture thus permitting flexibility in utilization of a particular page even after a mat 17 has been mounted thereon.

In further keeping with the invention, it should be noted that although mat 17 as depicted in FIGS. 13 through 17 evidence a mat whose recessed opening 26 evidences a square or somewhat rectangular shape, it is within the scope of this invention for the utilization of any aesthetically appealing geometric shape and/or configuration for said recessed opening 26 or combinations thereof to be used simultaneously.

In furtherance of the invention, it should additionally be understood, that although the illustrated embodiment thereof deals with an album, nothing herein should be considered so limiting. On the contrary, the invention herein set forth is capable of being embodied in any manner comparable to a book, booklet, pamphlet, volume of material, or other compilation of individual page members selectively bound about a common binding.

The preceding description and accompanying drawings relate primarily to a specific embodiment of the invention, and the invention in its broader aspect should not be so limited to one specific embodiment as herein shown and described, but departures may be made therefrom within the scope of the accompanying claims without departing from the principals of the invention and without sacrificing its chief advantages.

I claim:

1. An album design whose appearance is that of being a prebound structure but whose individual pages are capable of being selectively inserted or removed as desired so as to achieve an album of any desired size, said album comprising:

(a) pages capable of being selectively structurally interconnected with each other, each page comprising:

(i) a center core member formed to define along the binding portion thereof, symmetrical geometric recesses;

(ii) a first interconnecting spinal component fashioned to define tab members that are compatibly formed to structurally interfit with the symmetrical geometric recesses of said center core, there also being formed, as part of said first interconnecting spinal component, a first interconnecting tubular array comprising of symmetrically positioned spine members (iii) a first guide member shaped such that its dimensions are compatible with the dimensions of said center core member, said first guide member being structurally affixed to the front face of said center core member after the tab members of said first interconnecting spinal component are interfitted with the symmetrical geometric recesses of said center core thereby providing structural integrity to said page in addition to that provided by the interfit between said tab members of said first interconnecting spinal component and said symmetrical geometric recesses of said center core, and;

(iv) a second guide member shaped such that its dimensions are compatible with the dimension of said center core member, said second guide member being structurally affixed to the back face of said center core member after the tab members of said first interconnecting spinal component are interfitted with the symmetrical geometric recesses of said center core thereby providing structural integrity to said page in addition to that provided by the interfit between said tab members of said first interconnecting spinal component and said symmetrical geometric recesses of said center core;

(b) a front cover shaped to be compatible with said pages wherein there is structurally affixed along the interior portion and adjacent to the binding portion thereof a second interconnecting spinal component defining individual positioned spine members capable of mechanical interfit with said spine members of said first interconnecting spinal component of a page member; and (c) a back cover shaped to be compatible with said pages wherein there is structurally affixed along the interior portion and adjacent to the binding portion thereof a third interconnecting spinal component defining individually positioned spine members capable of mechanical interfit with said spine members of said first interconnecting spinal component of a page member.

2. An album design whose appearance is that of being a prebound structure but whose individual pages are capable of being selectively inserted or removed as desired so as to achieve an album of any desired size, as defined in claim 1 wherein said front cover additionally has affixed thereto along its edge that has said second interconnecting spinal component, a tongue member that is capable of aesthetically covering said exposed spine members of said pages once interconnected to form an album so as to give the appearance that said album is prebound.

3. An album design whose appearance is that of being a prebound structure but whose individual pages are capable of being selectively inserted or removed as desired so as to achieve an album of any desired size, as defined in claim 2 wherein said back cover additionally has formed therein along its edge that has said third interconnecting spinal component a pouch capable of having inserted therein said tongue member so as to give the aesthetic appearance that said album is prebound.

4. An album design whose appearance is that of being a prebound structure but whose individual pages are capable of being selectively inserted or removed as desired so as to achieve an album of any desired size, as defined in claim 1 wherein the geometric recesses formed in said center core member and the tab members of said first interconnecting spinal component are trapezoidal in shape.

5. An album design whose appearance is that of being a prebound structure but whose individual pages are capable of being selectively inserted or removed as desired so as to achieve an album of any desired size, as defined in claim 1 wherein said individual spine members are cylindrical in shape being formed at one end thereof so as to define a recess and being formed at its other end so as to define a point, the point of one of said spine members being structurally compatible to interfit with said recess of another of said spine members.

* * * * *